US007823555B2

(12) United States Patent
Bugescu et al.

(10) Patent No.: US 7,823,555 B2
(45) Date of Patent: Nov. 2, 2010

(54) LOW PROFILE VALVE LIFTER ASSEMBLY

(75) Inventors: Florin Bugescu, Canton, MI (US); James Westbrook, Clarkston, MI (US); Lutz Kirbach, Rochester Hills, MI (US); Richard Best, Garden City, MI (US)

(73) Assignee: Schaeffler KG, Herzogenaurach (DE)

( * ) Notice: Subject to any disclaimer, the term of this patent is extended or adjusted under 35 U.S.C. 154(b) by 280 days.

(21) Appl. No.: 12/183,348

(22) Filed: Jul. 31, 2008

(65) Prior Publication Data

US 2009/0031977 A1 Feb. 5, 2009

Related U.S. Application Data

(60) Provisional application No. 60/953,281, filed on Aug. 1, 2007.

(51) Int. Cl.
*F01L 1/14* (2006.01)

(52) U.S. Cl. ..... 123/90.5; 123/90.48; 123/90.52; 74/569

(58) Field of Classification Search ..... 123/90.39, 123/90.44, 90.45, 90.46, 90.48, 90.5, 90.52, 123/90.55; 74/567, 569
See application file for complete search history.

(56) References Cited

U.S. PATENT DOCUMENTS 7,424,876 B2 * 9/2008 Diggs ..... 123/90.41

* cited by examiner

*Primary Examiner*—Ching Chang
(74) *Attorney, Agent, or Firm*—Lucas & Mercanti, LLP

(57) ABSTRACT

The low profile valve lifter assembly has flats inside the bore of the outer housing and walls are formed and extended down from the plate of the guide such that the walls align with the flats of the bore to prevent rotation of the lifter with the guide. A groove and protuberance are provided in the flats and on the side wall of the guide in order to properly orient the lifter with the guide. The flats can be connected to form a pocket and the walls of the guide can be connected to form a sleeve that mates with the pocket.

16 Claims, 4 Drawing Sheets

LOW PROFILE VALVE LIFTER ASSEMBLY

FIELD OF THE INVENTION

This invention relates to internal combustion engines and, more particularly, to valve trains of internal combustion engines which employ a lifter between a push rod of the valve and the cam shaft of the engine.

BACKGROUND OF THE INVENTION

The valve train in a push rod engine uses a roller lifter which is installed in a lift guide. The roller lifter is acted on by a cam of the cam shaft which, in turn, acts on a push rod of a cylinder in the engine. The lift guide is used to prevent rotation along the axis of the roller lifter. In some applications, the lifter has to be installed in a unique position and in these cases, the lift guide often acts to orient the roller lifter.

Conventionally, the outer surface of the roller lifter interacts with the lift guide to prevent rotation and to provide proper orientation of the lift guide in the roller lifter.

Having the lift guide interact with the outer surface of the roller lifter has a number of disadvantages to include the sliding surface between the cylinder block and the lifter is reduced because a portion of the outside surface of the lifter is used for an anti-rotational feature; some of the mass of the lifter is accounted for by the anti-rotational guide; inertia forces are higher; the performance of the valve train is hampered by the increased weight and there is a cost associated with the increased mass employed in the roller lifter.

OBJECTS OF THE INVENTION

The object of the invention is to provide an improved roller lifter and lifter guide assembly with reduced size, mass, and cost.

These and other objects of the invention will be appreciated by reference to the following description.

SUMMARY OF THE INVENTION

The objects of the invention are obtained by using the inside of the roller lifter to provide orientation between the guide and the lifter and using the inside of the lifter to prevent rotation between the lifter and the guide. A pocket is created inside the lifter and the walls of the pocket interact with corresponding walls of the guide to prevent rotation. Preferably, a protuberance and groove are used in order to provide orientation.

Broadly, the valve lifter assembly of the present invention can be defined as:

a valve lifter and a guide for said lifter;

said lifter comprising an elongated outer housing, a cam follower mounted at one end of said housing, a bore in said housing, said bore having an opening at the other end of said housing, a hydraulic lash adjuster mounted in said bore, said adjuster having a push rod end facing said opening, a first and second flats positioned in said bore, adjacent the other end of the housing, said first and second flats each having an axially oriented flat surface and said adjuster positioned between said first and second flats, said guide comprising a plate adapted to be fixed to an engine, a push rod hole in said plate which aligns with said opening of said bore, a first and second walls extending downward from said plate, adjacent said push rod hole and said push rod hole positioned between said first and second walls, said first and second walls each having a flat surface that aligns with an opposing flat surface of said first and second flats to orient and prevent rotation of said lifter in said assembly.

The lifter can have a single hydraulic lash adjuster or two or more hydraulic lash adjusters.

Preferably, the outer surface of the housing is cylindrical.

Preferably, the side walls of the bore that connect the flats are curved such that the overall cross section, in a radial direction, of the bore at the other end of the housing is oval. The bore forms an oval shaped pocket when the flats are connected by the side walls.

Preferably, the walls of the guide are also connected such that a sleeve is formed which fits into the bore. The shape of the sleeve is preferably symmetrical to the shape of the bore. More specifically, the outer surface of the sleeve mates with the inner surface of the bore so that the guide provides orientation and anti-rotational properties to the lifter. Suitably, the first and the second walls are connected to form an oval shaped sleeve which is oval in shape, in a radial direction. Alternatively, the first and second walls are connected to form a sleeve such that the sleeve has a rectangular shape in a radial direction.

Preferably, one of the flats has either a groove or a protuberance and the opposing wall of the guide has the mating protuberance or groove. Using a protuberance and a groove helps proper orientation of the lifter and the guide. More preferably, the flat has the groove and the opposing wall has the protuberance.

Preferably, the groove extends the full length of the flat/wall. Also preferably, the protuberance extends the full length of the flat/wall such that it fills the full length of the groove. It is preferred that the groove be on the first flat and the protuberance on the first wall.

These and other aspects of the present invention may me more readily understood by reference to one or more of the following drawings which are chosen for purposes of illustration.

DETAILED DESCRIPTION OF THE DRAWINGS

Figure 1:
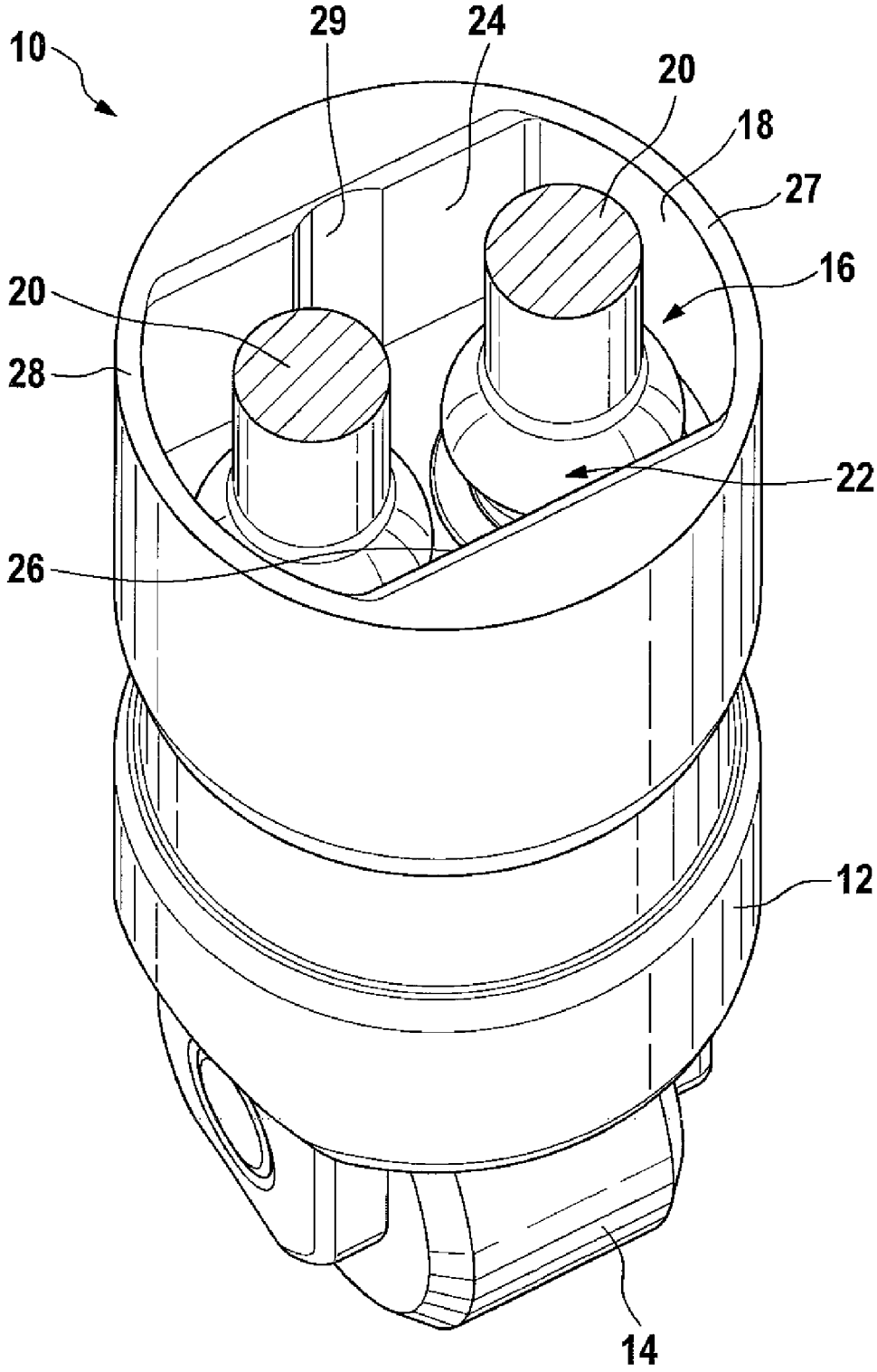
FIG. 1 is a perspective view of a valve lifter.

FIG. 1 illustrates dual valve lifter 10 having outer elongated housing 12 with cam follower 14 at one end and a bore 16 which has opening 18 at the other end of housing 12. Push rods 20 are shown which mate with the top of hydraulic lash adjusters 22 (more easily seen in FIG. 4).

Hydraulic lash adjusters 22 are mounted in housing 12 and the top of hydraulic lash adjusters 22 mate with push rods 20.

First flat 24 and second flat 26 are formed in bore 16 adjacent opening 18 at the other end of housing 12. As can be seen, first flat 24 and second flat 26 have flat surfaces that are aligned axially with the outer housing. It can also be seen that first and second flats 24, 26 form flat surfaces which are parallel to each other.

Cam follower 14, shown as a roller, is acted on by a cam on a cam shaft in order to cause lifter 10 to move in a reciprocal manner in response to the cam. Hydraulic lash adjusters 22 operate on push rods 20 to effect movement of a valve of a cylinder in an internal combustion engine. This interactions between the cam follower 14, hydraulic lash adjusters 22, push rods 20 and the valve are conventional.

As shown in FIG. 1, first flat 24 and second flat 26 are connected by curved side walls 27 and 28. Connecting first flat 24 to second flat 26 with curved side walls 27, 28 gives the bore an appearance of an oval in cross section taken in radial direction. Side walls 27 and 28 are concave as shown in FIG. 1.

Groove 29 is formed in first flat 24, and is illustrated as extending the full length of flat 24.

Figure 2:
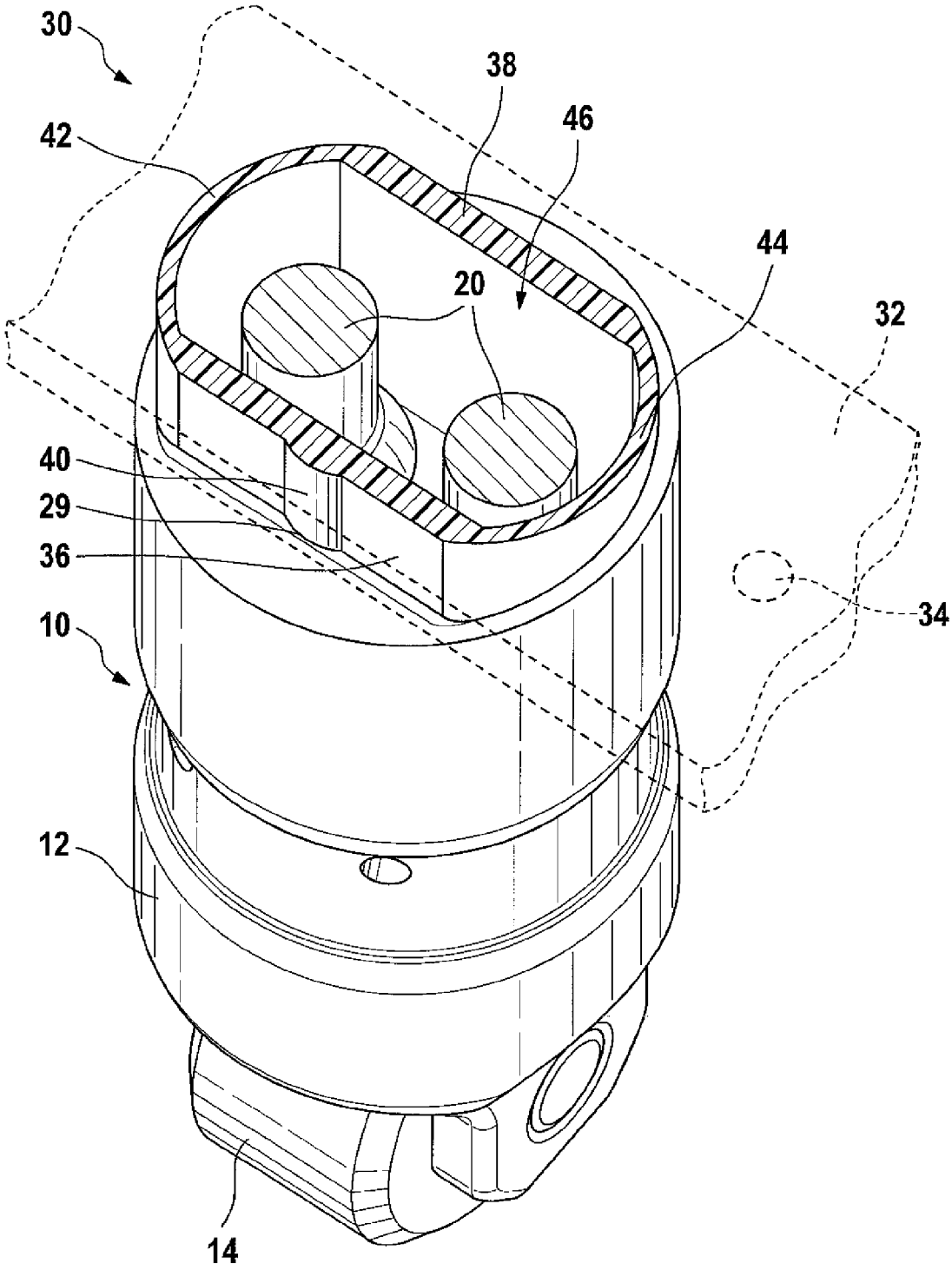
FIG. 2 is a perspective view of the valve lifter assembly of the present invention.

FIG. 2 illustrates the dual valve lifter assembly wherein guide 30 is positioned above lifter 10.

Guide 30 comprises a plate 32 with holes 34 for mounting in the engine block. Plate 32 has been shown by dashed lines in order to better illustrate the remaining portion of guide 30.

Specifically, first wall 36 and second wall 38 extend downwardly form plate 32. First wall 36 has protuberance 40 which mates with groove 29. As can be seen, first wall 36 and second wall 38 are joined by side walls 42 and 44. Joining of the first wall 36 and second wall 38 with curved end walls 42, 44 results in the walls taking on a sleeve configuration which is oval in cross section in a radial direction. To best illustrate this oval sleeve configuration, walls 36, 38, 42, 44 have been shown with solid lines while plate 32 has been shown with dashed lines. End walls 42, 44 are preferably convex. Push rod hole 46 takes on a shape which is the same as the shape of the inside of sleeve delimited by walls 36, 38, 42, 44. Push rod hole 46 allow for the passage of push rod 20 into housing 12 and contact with hydraulic lash adjusters 22.

Figure 3:
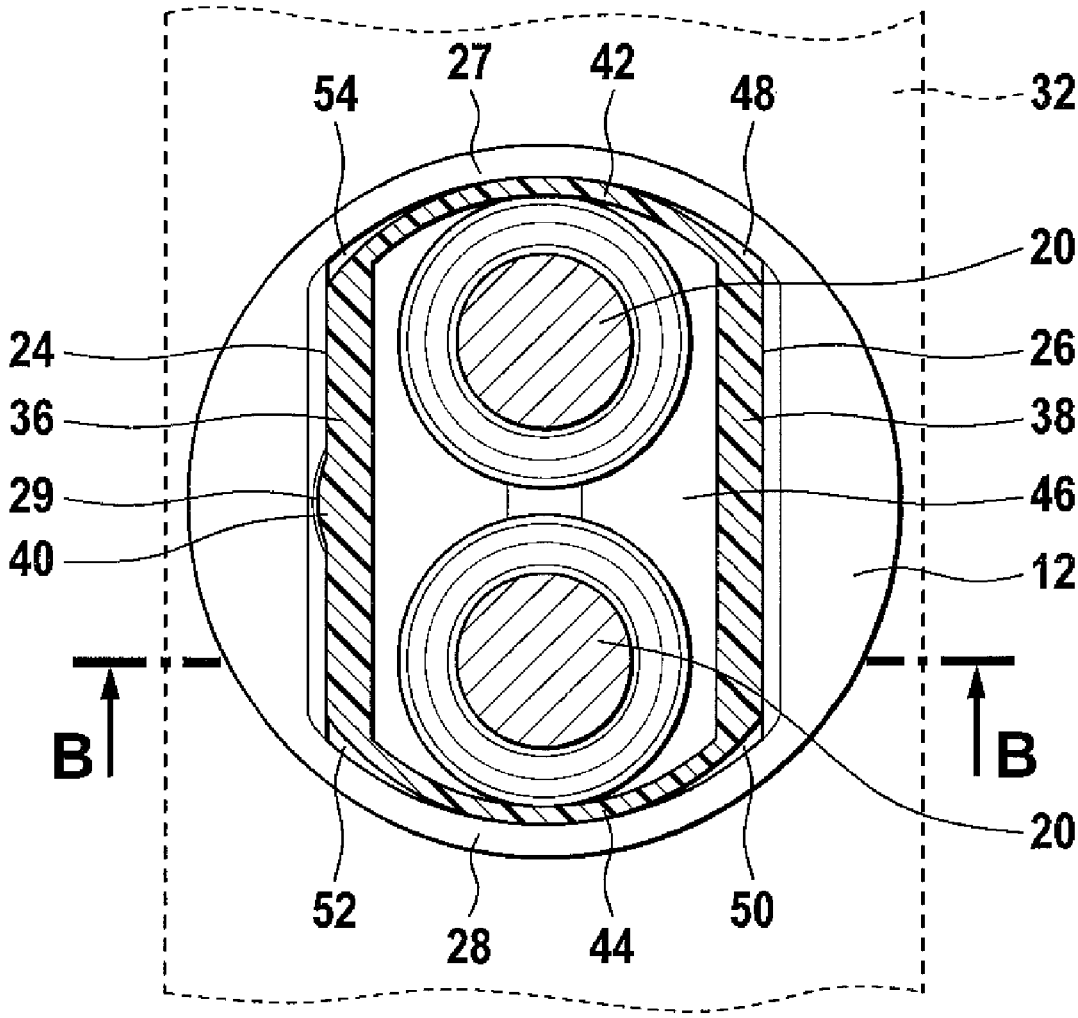
FIG. 3 is a top view of the valve lifter assembly of the present invention.

FIG. 3 shows a top view of FIG. 2. FIG. 3 illustrates push rods 20 extending up through plate 32. Plate 32 has been shown in break away format such that the mating of first and second flats 24, 26, with first and second walls 36, 38, and end walls 42, 44 with side walls 27, 28 is illustrated.

As can be seen in FIG. 3, first and second walls 36, 38 align with first and second flats 24 and 26, respectively, and prevent rotation of lifter 10 in the assembly.

It can also be seen in FIG. 3 that side walls 27, 28 align with end walls 42 and 44 in order to provide a snug fit. Spaces 48, 50, 52, and 54 are formed between side walls 27, 28 and end walls 42, 44. These spaces allow for flexibility between the side walls and provide flexibility between lifter 10 and guide 30.

Figure 4:
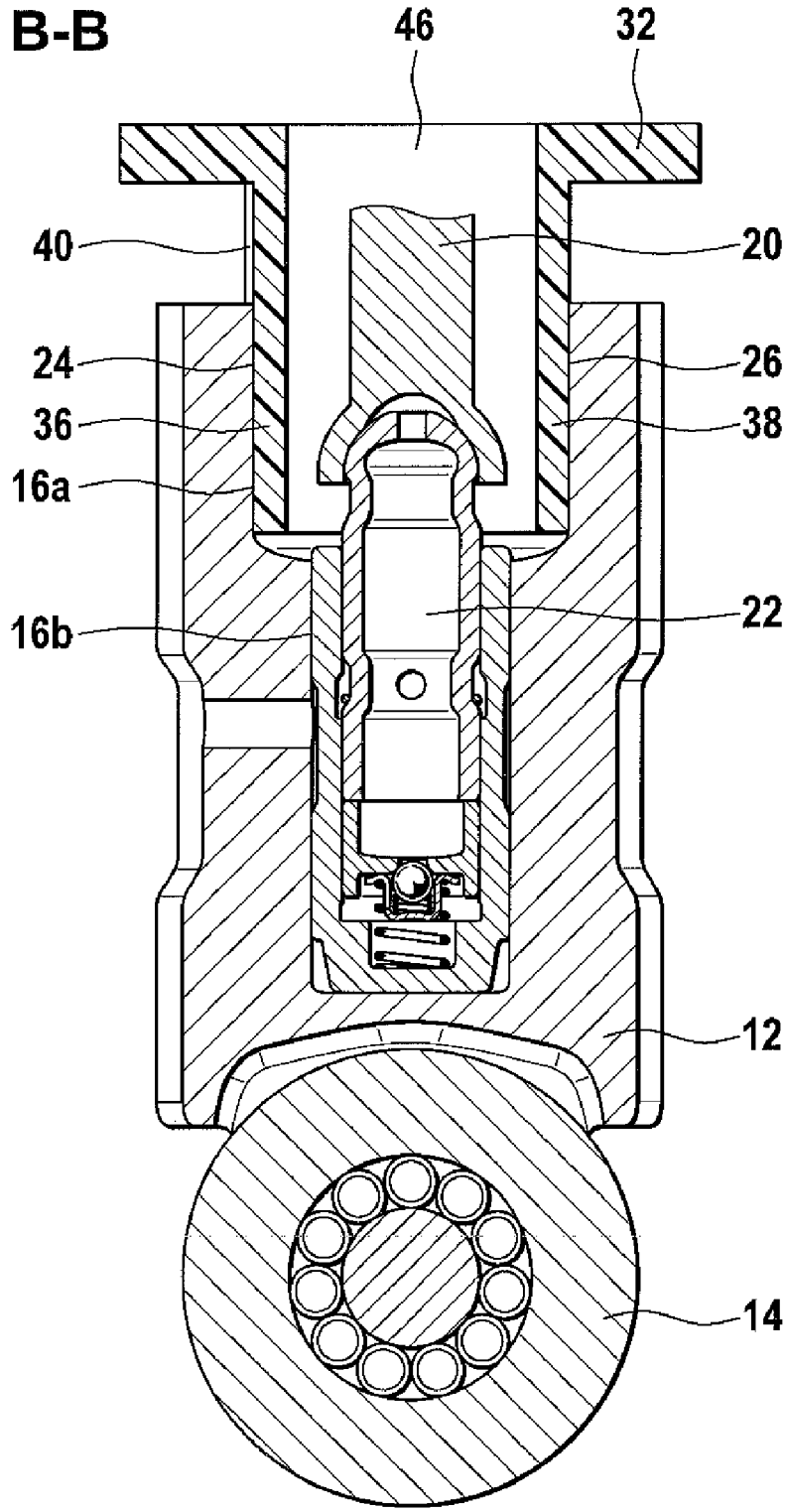
FIG. 4 is a cross sectional view taken along the lines B-B of FIG. 3.

FIG. 4 illustrates a cross section taken along line B-B in FIG. 3. As can be seen in FIG. 4, bore 16 has an upper profile 16*a* and a lower profile 16*b*. Lower profile 16*b* securely houses hydraulic lash adjusters 22 while upper profile 16*a* provides the oval shaped pocket with the necessary flats for mating with the oval shaped sleeve of the guide and for preventing rotation of the lifter when mounted with the guide. Also, it will be recognized that the guide and its sleeve are fixed while the lifter moves in a vertical, reciprocating manner. Thus the bottom of the sleeve must not extend into the pocket too far and must provide for the reciprocal movement of the pocket.

Housing 12 can be made of any conventional material in a conventional manner. Plastic is preferred, since it reduces the overall weight of the assembly. Likewise, guide 30 can be made of conventional material in a conventional manner. Preferably, plastic is employed so as to reduce the overall weight of the assembly.

REFERENCE CHARACTERS

10 dual valve lifter
12 outer elongated housing
14 cam follower
16 bore
16*a* upper profile/pocket
16*b* lower profile
18 opening
20 push rod
22 hydraulic lash adjusters
24 first flat
26 second flat
27 side wall
28 side wall
29 groove
30 guide
32 plate
34 holes
36 first wall
38 second wall
40 protuberance
42 end wall
44 end wall
46 push rod hole
48 spaces
50 spaces
52 spaces
54 spaces

What is claimed is:

1. A valve lifter assembly for an internal combustion engine comprising:

a valve lifter and a guide for said lifter;

said lifter comprising:

an elongated housing;

a cam follower mounted at one end of said housing, a bore in said housing, said bore having an opening at the other end of said housing, a hydraulic lash adjuster mounted in said bore, said adjuster having a push rod end facing said opening, a first and second flats position in said bore, adjacent the other end of the housing, each of said first and second flats having a axial oriented flat surface and said adjuster positioned between said first and second flats, said guide comprising:

a plate adapted to be fixed to an engine block, a push rod hole is on said plate which aligns with said opening of said bore a first and second walls extending downward from said plate and adjacent said push rod hole and said push rod hole positioned between said first and second walls, said first and second walls each having flat surfaces that align with an opposing flat surface of said first and second flats to orient and prevent rotation of said lifter in said assembly.

2. The assembly of claim 1 wherein said housing is cylindrical in shape.

3. The assembly of claim 1 wherein two hydraulic lash adjusters are mounted in said bore.

4. The assembly of claim 1 wherein said first and second flats are connected by curved end walls by curved side walls of said bore such, that said bore has an oval shape in a radial direction.

5. The assembly of claim 1 wherein said first and second walls are connected to form a sleeve which has an oval shape in a radial direction.

6. The assembly of claim 1 wherein said first and second flats are connected by curved side walls of said bore such, that said bore has an oval shape pocket, said first and second walls are connected by curved end walls to form an oval shaped sleeve, and said pocket and sleeve mate with each other.

7. The assembly of claim 1 wherein the first and second flats are side walls of said bore.

8. The assembly of claim 7 wherein said first and second flats are interconnected by curved side walls of said bore and form an oval shaped pocket.

9. The valve lifter assembly of claim 1 further comprising:

an axial orient groove in said first flat; and an axially oriented protuberance on said first wall, wherein said protuberance fitting into said groove to orient and prevent rotation of said lifter in said assembly.

10. The assembly of claim 9 wherein said housing is cylindrical in shape.

11. The assembly of claim 9 wherein two hydraulic lash adjusters are mounted in said bore.

12. The assembly of claim 9 wherein said first and second flats are connected by curved side walls of said bore such, that said bore has an oval shape in a radial direction.

13. The assembly of claim 9 wherein said first and second walls are connected by curved end walls to form a sleeve which has an oval shape in a radial direction.

14. The assembly of claim 9 wherein said first and second flats are connected by curved side walls of said bore to form an oval shaped pocket, said first and second walls are connected by convex end walls to form an oval shaped sleeve, and said sleeve mates with said pocket.

15. The assembly of claim 9 wherein said groove extends the length of said first flat.

16. The assembly of claim 15 wherein said protuberance extends the axial length of said first wall

* * * * *